US009875700B2

(12) United States Patent
Tsai et al.

(10) Patent No.: US 9,875,700 B2
(45) Date of Patent: Jan. 23, 2018

(54) SOURCE DRIVER AND DRIVING METHOD THEREOF

(71) Applicant: NOVATEK Microelectronics Corp., Hsin-Chu (TW)

(72) Inventors: Yueh-Hsun Tsai, Taipei (TW); Yi-Chuan Liu, Hsinchu (TW); Yueh-Hsiu Liu, Hsinchu (TW)

(73) Assignee: NOVATEK Microelectronics Corp., Hsin-Chu (TW)

( * ) Notice: Subject to any disclaimer, the term of this patent is extended or adjusted under 35 U.S.C. 154(b) by 0 days.

(21) Appl. No.: 14/242,859

(22) Filed: Apr. 1, 2014

(65) Prior Publication Data

US 2015/0116193 A1 Apr. 30, 2015

(30) Foreign Application Priority Data

Oct. 29, 2013 (TW) ..... 102139131 A

(51) Int. Cl.
*G09G 3/36* (2006.01)

(52) U.S. Cl.
CPC ..... *G09G 3/3614* (2013.01); *G09G 3/3688* (2013.01); *G09G 2310/027* (2013.01); *G09G 2310/0297* (2013.01)

(58) Field of Classification Search
CPC ..... G09G 3/3614; G09G 2310/027; G09G 2370/14; G09G 2370/08
USPC ..... 345/96
See application file for complete search history.

(56) References Cited

U.S. PATENT DOCUMENTS 5,298,912 A 3/1994 Mano
7,847,779 B2 * 12/2010 Liao ..... G09G 3/20 345/204
2003/0090451 A1 5/2003 Ahn
2003/0132907 A1 7/2003 Lee
2004/0257328 A1 12/2004 Lim
2007/0216630 A1 * 9/2007 Liao ..... G09G 3/20 345/100
2009/0237395 A1 * 9/2009 Lee ..... 345/214
(Continued)

FOREIGN PATENT DOCUMENTS

CN 1417771 A 5/2003
CN 1432989 A 7/2003
(Continued)

*Primary Examiner* — Yuzhen Shen
(74) *Attorney, Agent, or Firm* — Winston Hsu

(57) ABSTRACT

A source driver utilized for a display device and switching between two operational modes includes a reception module for receiving a plurality of display information and a plurality of transmission channels. Each transmission channel includes a register module for receiving one of the plurality of display information; a voltage level transformer for determining a voltage level of the one of display information; a polarization digital-to-analog converter for processing a digital-to-analog operation for the voltage level of the one display information; and an output module for outputting a plurality of voltage levels of the display information. The voltage levels of every two adjacent transmission channels include different polarization of voltage levels, and the output module processes an odd-number switching operation before outputting the plurality of voltage levels.

8 Claims, 14 Drawing Sheets

(56) References Cited

U.S. PATENT DOCUMENTS

| | | | | |
|---|---|---|---|---|
| 2009/0295762 | A1* | 12/2009 | Fan | G09G 3/3611 345/204 |
| 2009/0303217 | A1* | 12/2009 | Chen | G09G 3/3685 345/211 |
| 2010/0231577 | A1* | 9/2010 | Kim et al. | 345/212 |
| 2011/0007057 | A1* | 1/2011 | Fukuo | 345/211 |
| 2011/0102471 | A1* | 5/2011 | Hsu | G09G 3/3614 345/690 |
| 2012/0086677 | A1* | 4/2012 | Lin et al. | 345/204 |
| 2012/0133847 | A1* | 5/2012 | Moon | G09G 3/3611 348/790 |
| 2014/0168183 | A1* | 6/2014 | Yang | 345/209 |
| 2014/0198086 | A1* | 7/2014 | Cheng | G09G 3/20 345/209 |

FOREIGN PATENT DOCUMENTS

| | | | |
|---|---|---|---|
| CN | 102136264 | A | 7/2011 |
| CN | 102968977 | A | 3/2013 |
| TW | 200703221 | | 1/2007 |
| TW | 200703222 | | 1/2007 |
| TW | 200705374 | | 2/2007 |
| TW | 201001393 | | 1/2010 |
| TW | 201119228 | | 6/2011 |
| TW | 201214377 | | 4/2012 |
| TW | 201227667 | | 7/2012 |
| TW | 201303839 | | 1/2013 |

* cited by examiner

SOURCE DRIVER AND DRIVING METHOD THEREOF

BACKGROUND OF THE INVENTION

1. Field of the Invention

The present invention relates to a source driver and a driving method thereof, and more particularly, to a source driver and a driving method thereof which utilize a mapping operation and an odd-number switching operation to switch the source driver being operated in two operational modes.

2. Description of the Prior Art

As technology advances, people gradually pursue higher resolution as well as thinner/smaller size of hardware devices. A conventional display device includes a plurality of transmission channels corresponding to a plurality of source drivers, such that the adjacent transmission channels marked with an odd number and an even number can be adaptively designed to share one digital-to-analog converter, and an even-number switching operation can also be applied to the adjacent transmission channels, so as to complete a driving method for the source drivers of the display device. In detail, the conventional source driver can be operated in two operational modes, as shown in FIG. 1A, FIG. 1B, FIG. 2A and FIG. 2B. FIG. 1A and FIG. 1B are schematic diagrams of a conventional source driver 10 to be operated in a first operational mode, wherein FIG. 1A illustrates a schematic diagram of the source driver 10 receiving a display information INDA_1 generated by a timing generator (not shown in the figure), and FIG. 1B illustrates a schematic diagram of the source driver 10 outputting the display information INDA_1 shown in FIG. 1A. Besides, FIG. 2A and FIG. 2B are schematic diagrams of the conventional source driver 10 to be operated in a second operational mode, wherein FIG. 2A illustrates a schematic diagram of the source driver 10 receiving a display information INDA_2 generated by a timing generator (not shown in the figure), and FIG. 2B illustrates a schematic diagram of the source driver 10 outputting the display information INDA_2 shown in FIG. 2A.

As shown in FIG. 1A, the display information INDA_1 received by the source driver 10 is a serial information and comprises display information DATA(A), DATA(B), . . . , DATA(X) and DATA(Y). As shown in FIG. 1B, the source driver 10 further comprises a shift register 100 to receive the display information INDA_1. The source driver 10 further comprises transmission channels CH[n], CH[n+1], . . . , CH[m−1] and CH[m], and each transmission channel CH[X] comprises a register 102_X, a voltage level transformer 104_X, a positive (or negative) polarization digital-to-analog converter 106_X and an operational amplifier 108_X. The register 102_X further comprises a first register unit 102_1_X and a second register unit 102_2_X. Besides, the display information INDA_2 shown in FIG. 2A is identical to the display information INDA_1 shown in FIG. 1A, and the source driver 20 shown in FIG. 2B is similar to the source driver 10 shown in FIG. 1B, wherein a difference is a connection way for two adjacent transmission channels, e.g. the first register unit 102_1_X and the second register unit 102_2_X, such that the display information INDA_1 and INDA_2 outputted by the transmission channels CH[n], CH[n+1], . . . , CH[m−1] and CH[m] of the source drivers 10 and 20 are different with two types of polarization of display sub-information.

As shown in FIG. 1A and FIG. 1B, when the source driver 10 is operated in the first operational mode and the shift register 100 has received the display information INDA_1, the source driver 10 sequentially transmits the display information DATA(A), DATA(B), . . . , DATA(X) and DATA(Y) of the display information INDA_1 to the transmission channels CH[n], CH[n+1], . . . , CH[m−1] and CH[m], and accordingly, the display information DATA(A), DATA(B), . . . , DATA(X) and DATA(Y) sequentially pass through the register 102_X, the voltage level transformer 104_X, the positive (or negative) polarization digital-to-analog converter 106_X and the operational amplifier 108_X, to be outputted as the two types of polarization of display sub-information. The first type of polarization is a positive voltage level, such as voltages V(A), V(C), . . . V(X) correspondingly being transmitted to the transmission channels CH[n], CH[n+2], . . . , CH[m−1], and the second type of polarization is a negative voltage level, such as voltages −V(B), −V(D), . . . , −V(Y) correspondingly being transmitted to the transmission channels CH[n+1], CH[n+3], . . . , CH[m].

Furthermore, as shown in FIG. 2A and FIG. 2B, when the source driver 20 is operated in the second operational mode and the shift register 100 has received the display information INDA_1, the source driver 20 sequentially transmits the display information DATA(A), DATA(B), . . . , DATA(X) and DATA(Y) of the display information INDA_1 to the transmission channels CH[n], CH[n+1], . . . , CH[m−1] and CH[m]. In comparison with the operation of the source driver 10, the first register units 102_1_X and 102_1_X+1 and the second register units 102_2_X and 102_2_X+1 of the adjacent transmission channels CH[X] and CH[X+1] of the source driver 20 have different connections, i.e. the first register unit 102_1_X is coupled to the second register unit 102_2_X+1 and the first register unit 102_1_X+1 is coupled to the second register unit 102_2_X, such that the adjacent transmission channels process a switching operation once for the display information. After passing through the second register units 102_2_X and 102_2_X+1, the display information DATA(A), DATA(B), . . . , DATA(X) and DATA(Y) are transmitted to pass the voltage level transformer 104_X and the positive (or negative) polarization digital-to-analog converter 106_X, and accordingly, another switching operation for the display information is processed before the display information DATA(A), DATA(B), . . . , DATA(X) and DATA(Y) enter the operational amplifier 108_X. Thus, the two types of polarization of display sub-information are correspondingly outputted, and in contrast with the source driver 10, the source driver 20 outputs the first type of polarization as a negative voltage level, such as voltages −V(A), −V(C), . . . , −V(X) to be correspondingly transmitted to the transmission channels CH[n], CH[n+2], . . . , CH[m−1], and the second type of polarization as a positive voltage level, such as voltages V(B), V(D), . . . , V(Y) to be correspondingly transmitted to the transmission channels CH[n+1], CH[n+3], . . . , CH[m].

As can be seen in FIG. 1A and FIG. 2A, although the source drivers 10 and 20 receive the same display information, the corresponding voltage levels outputted by the positive (or negative) polarization digital-to-analog converter are exactly opposite, i.e. the transmission channels CH[n]-CH[m] of the source driver 10 sequentially output a plurality of voltage levels as V(A), −V(B), V(C), −V(D), . . . , V(X) and −V(Y), and the transmission channels CH[n]-CH[m] of the source driver 20 sequentially output a plurality of voltage levels as −V(A), V(B), −V(C), V(D), . . . , −V(X) and V(Y). Due to different operational modes, the source drivers 10 and 20 are necessary to utilize two (or even numbers) switching operations for the display information, so as to output different polarizations of the display information for different transmission channels. After receiving a plurality of display information, conventional operations of the source drivers 10 and 20 are necessary to first determine what kinds of the operational modes are, so as to adjust/switch connections of a plurality of register units of every two adjacent transmission channels, which leads less flexible applications. Therefore, it has been an important issue to provide another flexible design and driving method for the source driver utilized for a display device.

SUMMARY OF THE INVENTION

It is the object of the invention to provide a source driver and a driving method thereof which utilize a mapping operation and an odd-number switching operation to switch the source driver being operated in two operational modes.

According to an aspect of the disclosure, a source driver utilized for a display device and switching between two operational modes is provided. The source driver comprises a reception module, for receiving a plurality of display information; a plurality of transmission channels, wherein each transmission channel of the plurality of transmission channels comprises a register module, coupled to the reception module, for receiving one of the plurality of display information; a voltage level transformer, coupled to the register module, for determining a voltage level of one of the plurality of display information; and a polarization digital-to-analog converter, coupled to the register module, for processing a digital-to-analog operation for the voltage level of the one of the plurality of display information; and an output module, coupled to a plurality of polarization digital-to-analog converters of the plurality of transmission channels, for outputting a plurality of voltage levels corresponding to the plurality of display information having been processed by the digital-to-analog operation; wherein the plurality of voltage levels corresponding to every two adjacent transmission channels comprise different polarization of voltage levels, and the output module further processes an odd-number switching operation before outputting the plurality of voltage levels.

According to an aspect of the disclosure, a driving method for a source driver utilized for a display device, wherein the source driver is switched between two operational modes, is provided. The driving method comprises receiving a plurality of display information and determining a plurality of voltage levels of the plurality of display information; processing a digital-to-analog operation for the plurality of voltage levels of the plurality of display information in a plurality of transmission channels; and processing, via an output module of the source driver, an odd-number switching operation for the plurality of voltage levels of the plurality of the display information having been processed by the digital-to-analog operation; wherein the plurality of voltage levels corresponding to every two adjacent transmission channels comprise different polarization of voltage levels.

These and other objectives of the present invention will no doubt become obvious to those of ordinary skill in the art after reading the following detailed description of the preferred embodiment that is illustrated in the various figures and drawings.

DETAILED DESCRIPTION

The specification and the claims of the present invention may use a particular word to indicate an element, which may have diversified names named by distinct manufacturers. The present invention distinguishes the element depending on its function rather than its name. The phrase "comprising" used in the specification and the claim is to mean "is inclusive or open-ended but not exclude additional, unrecited elements or method steps." In addition, the phrase "electrically connected to" or "coupled" is to mean any electrical connection in a direct manner or an indirect manner. Therefore, the description of "a first device electrically connected or coupled to a second device" is to mean that the first device is connected to the second device directly or by means of connecting through other devices or methods in an indirect manner.

Figure 1A:
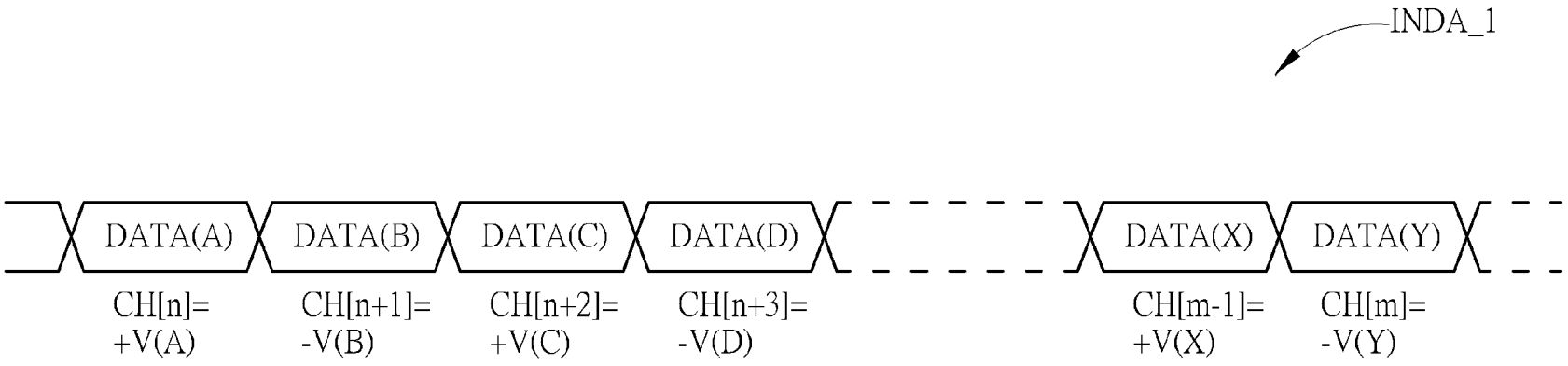
FIG. 1A PRIOR ART
FIG. 1A and FIG. 1B are schematic diagrams of a conventional source driver to be operated in a first operational mode.
Figure 1B:
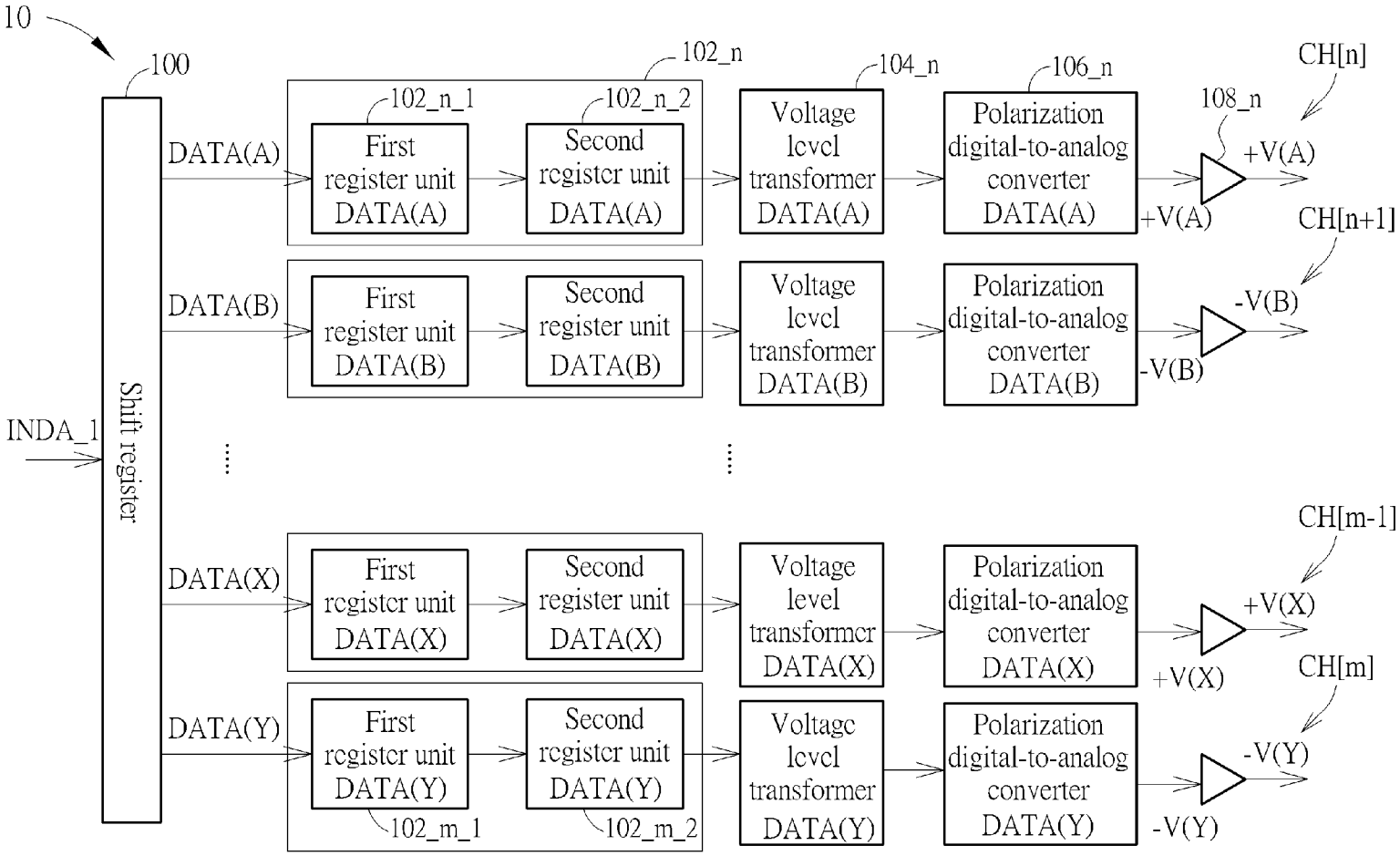
FIG. 1B PRIOR ART

In comparison with conventional source drivers, embodiments of the invention also provide a source driver to be operated in two operational modes, and the same hardware hierarchy/design of the source driver of the invention can be utilized for both two operational modes without changes. When being operated in the first operational mode, the source driver receives the same display information INDA_1 shown in FIG. 1A, and related operations of the source driver are similar with the operations of the source driver 10 shown in FIG. 1B, which is not described hereinafter for brevity. When being operated in the second operational mode, the source driver of the invention receives a mapped display information, and following paragraphs are utilized for demonstrations.

Figure 3A:
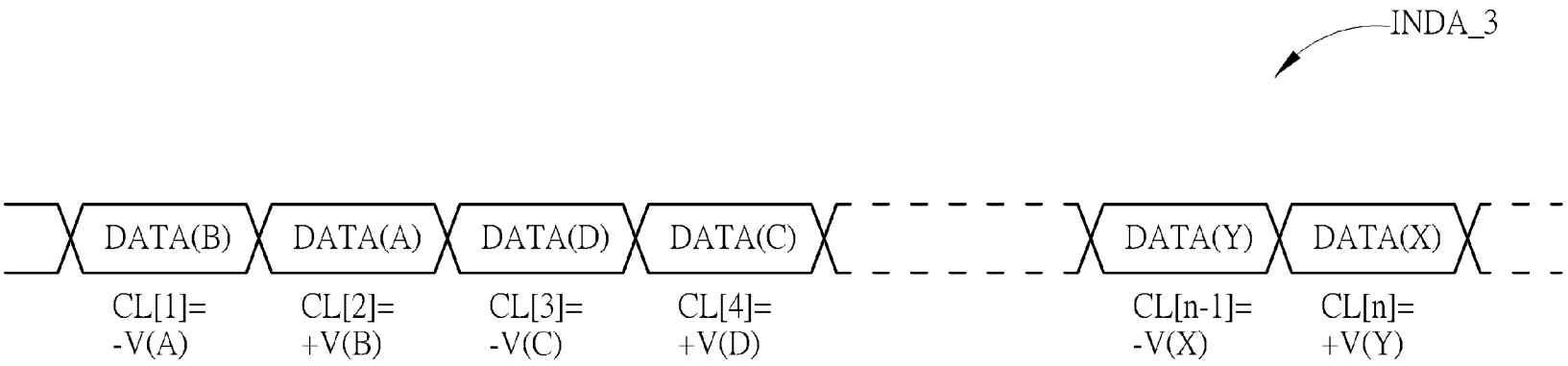
FIG. 3A illustrates a schematic diagram of a display information having being processed by a mapping operation according to an embodiment of the invention.
Figure 3B:
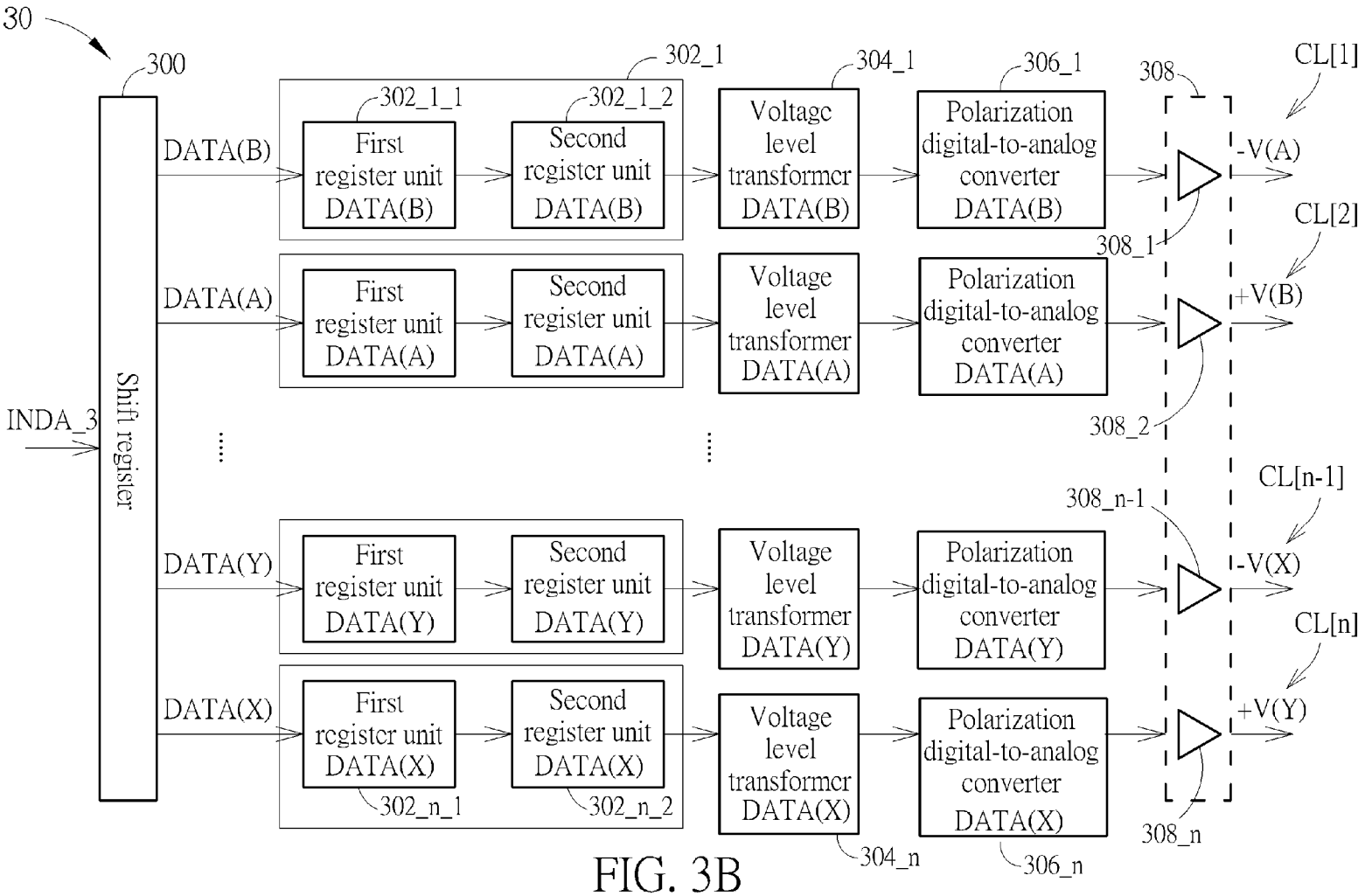
FIG. 3B illustrates a schematic diagram of a source driver receiving the display information shown in FIG. 3A according to an embodiment of the invention.

Please refer to FIG. 3A and FIG. 3B, wherein FIG. 3A illustrates a schematic diagram of a display information INDA_3 having being processed by a mapping operation according to an embodiment of the invention, and FIG. 3B illustrates a schematic diagram of a source driver 30 receiving the display information INDA_3 shown in FIG. 3A according to an embodiment of the invention. Utilizing a timing controller (not shown in the figure) and a polarization control signal (not shown in the figure), the display information INDA_3 of the embodiment can be obtained from the display information INDA_1 to be processed by a mapping operation, i.e. the display information INDA_3 is a serial information and comprises the display information as DATA(B), DATA(A), DATA(D), DATA(C), . . . , DATA(Y) and DATA(X), wherein the mapping operation of the embodiment can be adaptively selected for considering different hardware/software designs of the timing controller and the polarization control signal, and is not limiting the scope of the invention. As shown in FIG. 3B, the source driver 30 comprises a shift register 300, transmission channels CL[1], CL[2], . . . , CL[n−1] and CL[n] and an output module 308. Each transmission channel CL[X] comprises a register module 302_X, a voltage level transformer 304_X, a polarization digital-to-analog converter 306_X, and the output module 308 comprises operational amplifiers 308_1-308_*n* to be correspondingly coupled to the transmission channels CL[1]-CL[n]. The register module 302_X further comprises a first register unit 302_1_X and a second register unit 302_2_X.

Under such circumstances, when the shift register 300 of the source driver 30 receives the mapped display information INDA_3, the display information DATA(B), DATA(A), DATA(D), DATA(C), . . . , DATA(Y) and DATA(X) can be correspondingly transmitted to the first register units 302_1_1-302_1_*n* of the register modules 302_1-302_*n* of the transmission channels CL[1]-CL[n]. After a waiting period (or via a control signal), the display information DATA(B), DATA(A), DATA(D), DATA(C), . . . , DATA(Y) and DATA(X) of the first register units 302_1_1-302_1_*n* can further be correspondingly transmitted to the second register units 302_2_1-302_2_*n* to make sure a correct transmission of the display information.

Next, the second register units 302_2_1-302_2_*n* output the display information DATA(B), DATA(A), DATA(D), DATA(C), . . . , DATA(Y) and DATA(X) to the voltage level transformers 304_1-304_*n*, to determine voltage levels of different display information, so as to transmit a plurality of voltage levels of the display information DATA(B), DATA(A), DATA(D), DATA(C), . . . , DATA(Y) and DATA(X) to the polarization digital-to-analog converter 306_1-306_*n* for a digital-to-analog operation. Preferably, in the embodiment, signals outputted by the voltage level transformers 304_1-304_*n* are digital signals, and signals outputted by the polarization digital-to-analog converters 306_1-306_*n* are analog signals. Also, every two adjacent transmission channels of the embodiment share one polarization digital-to-analog converter, such as the transmission channel CL[1] comprises a positive polarization digital-to-analog converter, the transmission channel CL[2] comprises a negative polarization digital-to-analog converter, the transmission channel CL[3] comprises a positive polarization digital-to-analog converter, the transmission channel CL[4] comprises a negative polarization digital-to-analog converter, and so on, which means that any two adjacent transmission channels of the transmission channels CL[1]-CL[n] may output different polarization of voltage levels. Positions of the positive polarization digital-to-analog converter or the negative polarization digital-to-analog converter between the transmission channels can be adaptively switched/adjusted, and are not limiting the scope of the invention.

Lastly, the output module 308 correspondingly receives the plurality of analog signals (i.e. the determined voltage levels) of the display information DATA(B), DATA(A), DATA(D), DATA(C), . . . , DATA(Y) and DATA(X) to process the odd-number switching operation, so as to re-arrange positions of the plurality of analog signals corresponding to the plurality of display information, and accordingly, the operational amplifiers 308_1-308_*n* of the output module 308 receives the plurality of analog signals being processed the odd-number switching operation, to amplify the plurality of voltage levels of the plurality of display information, such that the source driver 30 can sequentially output the voltage levels −V(A), V(B), −V(C), V(D), . . . , −V(X) and V(Y). Preferably, the odd-number switching operation of the embodiment only switches the analog signals corresponding to the two adjacent transmission channels of the plurality of transmission channels CL[1]-CL[n] once, which means that the output module 308 receives the voltage levels as V(B), −V(A), V(D), −V(C), . . . , V(Y) and −V(X), and the corresponding outputting voltage levels are −V(A), V(B), −V(C), V(D), . . . , −V(X) and V(Y). Those skilled in the art can adaptively modify operations of the output module 308, such that the voltage levels corresponding to the two adjacent transmission channels of the transmission channels CL[1]-CL[n] can be switched with another predetermined odd number, such as 3 times or 5 times, to adaptively output the voltage levels as −V(A), V(B), −V(C), V(D), . . . , −V(X) and V(Y), which is also in the scope of the invention.

In simple, when the source driver 30 of the embodiment is operated in the second operational mode, the source driver 30 receives the mapped display information to be transmitted to the transmission channels CL[1]-CL[n] with the digital-to-analog operation, such that the plurality of voltage levels of the display information are correspondingly outputted to the output module 308 for the odd-number switching operation, to re-arrange positions of the plurality of voltage levels of the display information, so as to amplify, via the operational amplifiers 308_1-308_*n*, the plurality of voltage levels of the display information as −V(A), V(B), −V(C), V(D), . . . , −V(X) and V(Y), which is also shown in FIG. 3A that the transmission channels CL[1]-CL[n] corresponding to the display information DATA(B), DATA(A), DATA(D), DATA(C), . . . , DATA(Y) and DATA(X) output the plurality of voltage levels as −V(A), V(B), −V(C), V(D), . . . , −V(X) and V(Y), respectively.

Figure 2A:
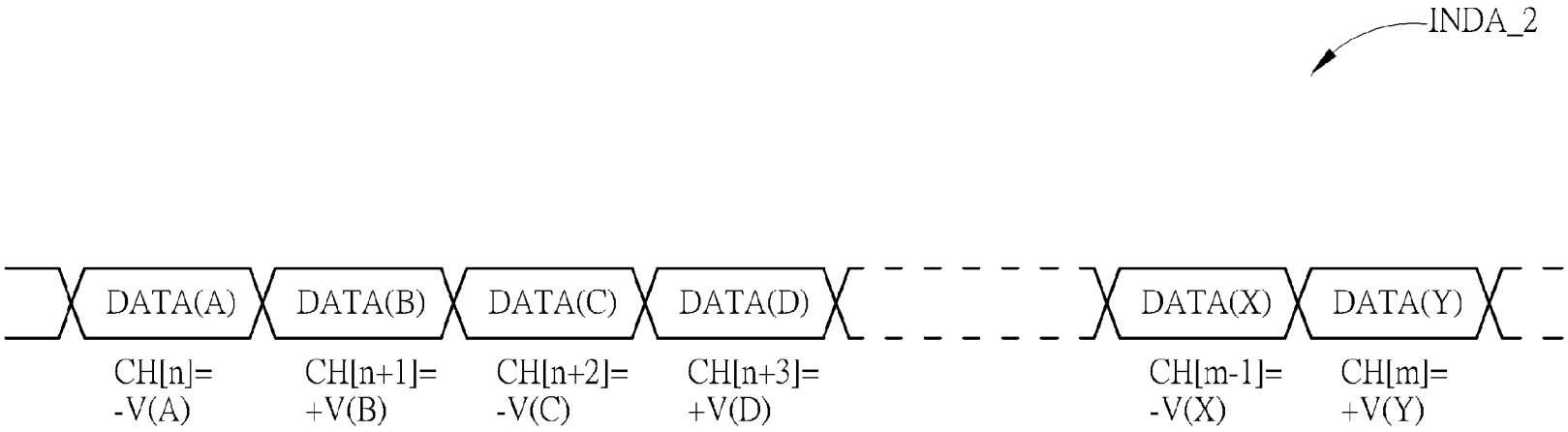
FIG. 2A PRIOR ART
FIG. 2A and FIG. 2B are schematic diagrams of the conventional source driver to be operated in a second operational mode.
Figure 2B:
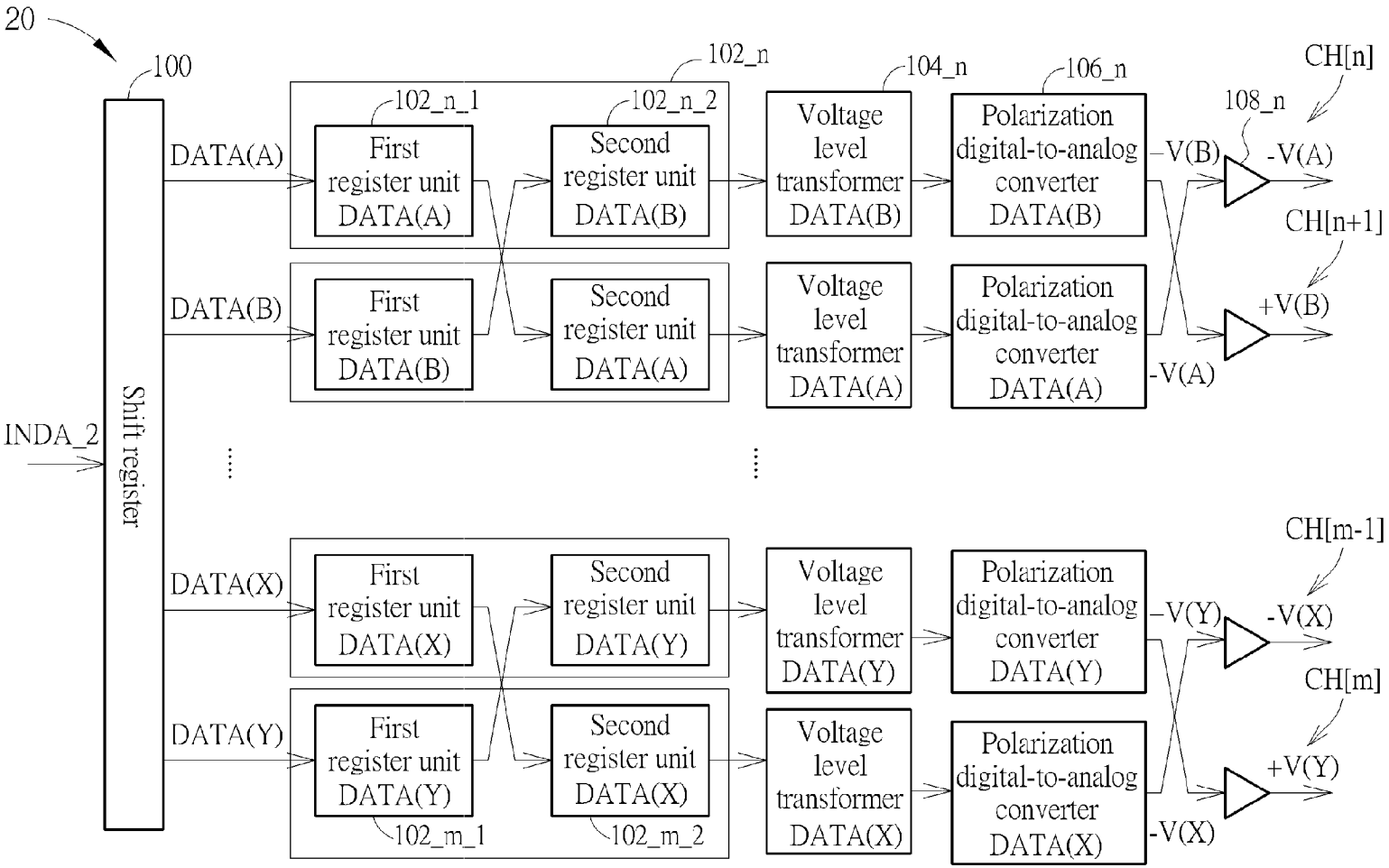
FIG. 2B PRIOR ART

In other words, after the display information DATA(B), DATA(A), DATA(D), DATA(C), . . . , DATA(Y) and DATA(X) are inputted into the source driver 30, the voltage levels −V(A), V(B), −V(C), V(D), . . . , −V(X) and V(Y) are correspondingly outputted. In comparison with the prior art (as shown in FIG. 2A and FIG. 2B), after the source driver 20 receives the display information DATA(A), DATA(B), DATA(C), DATA(D), . . . , DATA(X) and DATA(Y) to be cooperated with the transmission channels with another twice (or the even-number) switching operation of the display information, different polarization of the display information can be correspondingly obtained. In the embodiment of the invention, the source driver 30 receives the mapped display information and cooperates with the output module 308 with the odd-number switching operation, such that the different polarization of the voltage levels of the display information can be obtained as −V(A), V(B), −V(C), V(D), . . . , −V(X) and V(Y). Meanwhile, in the embodiment of the invention it is not necessary to alter connections of hardware devices/units while being operated in different operational modes to render more flexibility for the source driver 30.

Figure 4A:
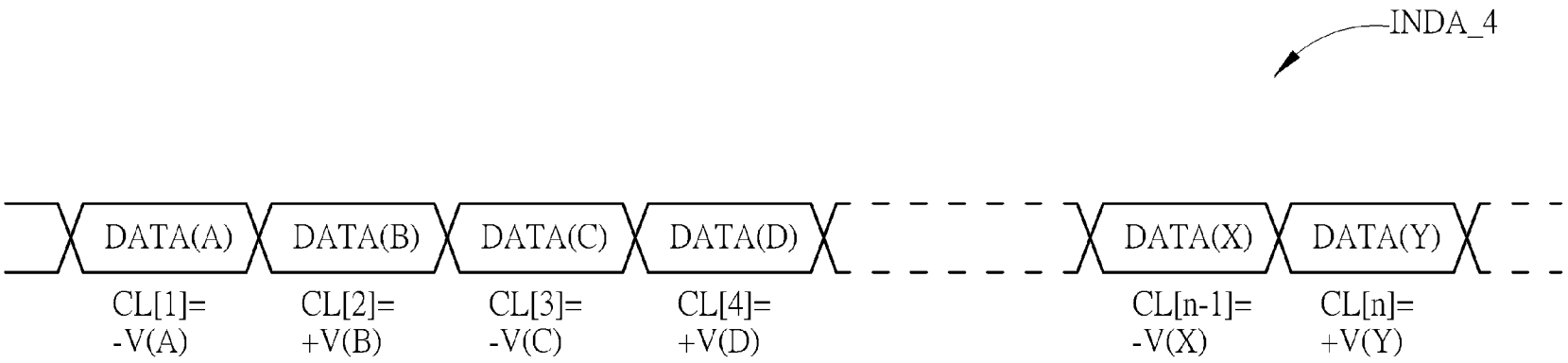
FIG. 4A illustrates a schematic diagram of a received display information according to an embodiment of the invention.
Figure 4B:
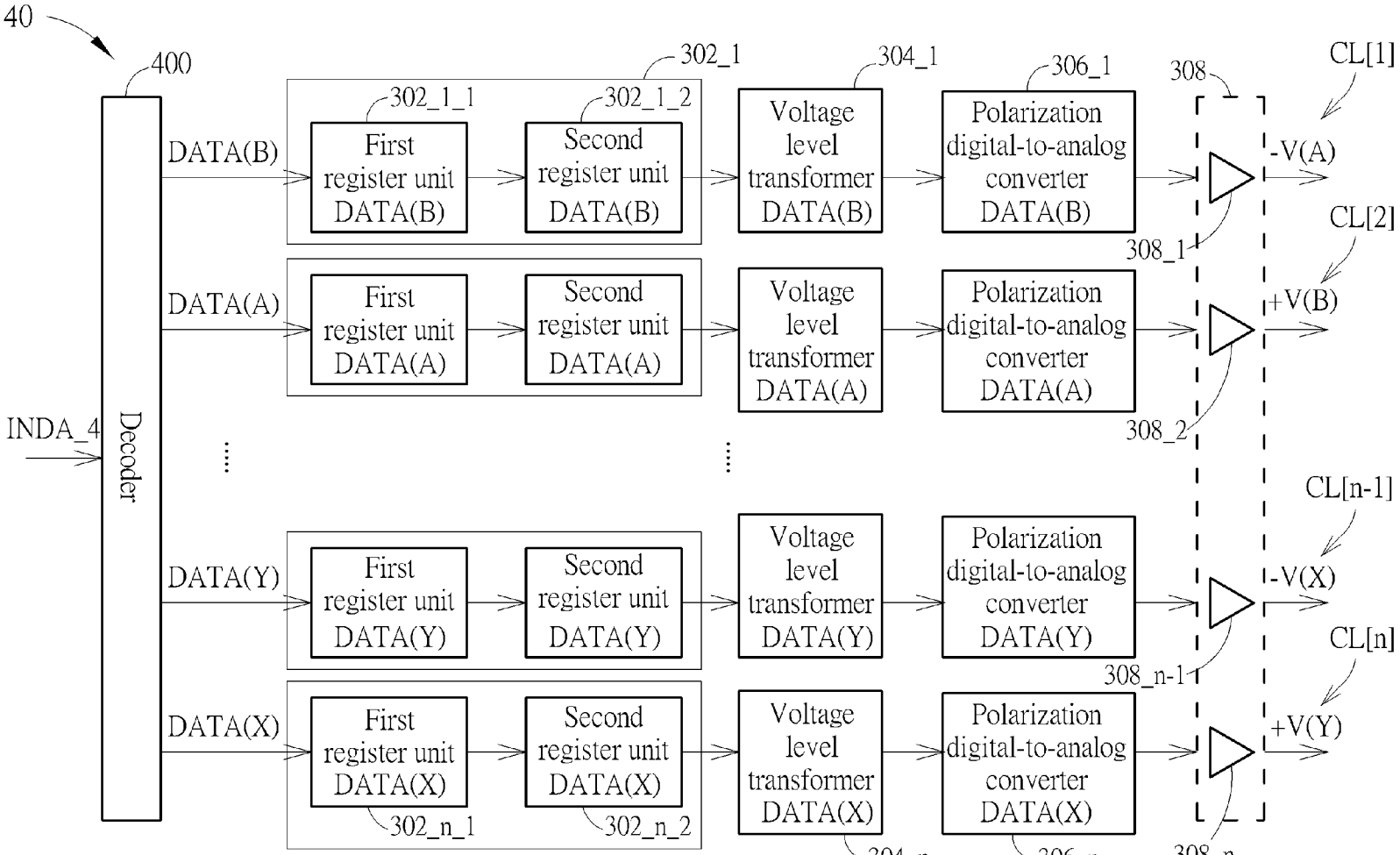
FIG. 4B illustrates a schematic diagram of a source driver receiving the display information shown in FIG. 4A according to an embodiment of the invention.

Please refer to FIG. 4A and FIG. 4B, wherein FIG. 4A illustrates a schematic diagram of a received display information INDA_4 according to an embodiment of the invention, and FIG. 4B illustrates a schematic diagram of a source driver 40 receiving the display information INDA_4 shown in FIG. 4A according to an embodiment of the invention. The source driver 40 also supports the first operational mode and the second operational mode. As shown in FIG. 4A and FIG. 4B, when the source driver 40 is operated in the second operational mode, the received display information INDA_4 is similar to the display information INDA_1 shown in FIG. 1 and comprises the display information DATA(A), DATA (B), . . . , DATA(X) and DATA(Y). Besides, the source driver 40 shown in FIG. 4B is similar to the source driver 30 and comprises almost the same composition of modules/units, wherein a difference is that the source driver 40 further comprises a decoder 400 to replace the shift register 300 of the source driver 30. Accordingly, the decoder 400 of the source driver 40 not only receives the display information DATA(A), DATA(B), . . . , DATA(X) and DATA(Y), but also receives at least one polarization setting signal corresponding to the display information DATA(A), DATA(B), . . . , DATA(X) and DATA(Y). For example, a polarization control signal POL and a frame initiation signal YDIO of the embodiment are provided to the decoder 400, such that the decoder 400 maps the display information INDA_4 to be DATA(B), DATA(A), . . . , DATA(Y) and DATA(X) to the transmission channels CL[1]-CL[n] according to the polarization control signal POL and the frame initiation signal YDIO, and correspondingly outputs DATA(B) to the transmission channel CL[1], outputs DATA(A) to the transmission channel CL[2], . . . , outputs DATA(Y) to the transmission channel CL[n−1] and outputs DATA(X) to the transmission channel CL[n]. Those skilled in the art can adaptively replace the polarization control signal POL and the frame initiation signal YDIO with other setting signals or operations for adjusting/setting the polarization of the display information, which is not limiting the scope of the invention. In addition, operations of the first register units 302_1_1-302_1_*n* and the second register units 302_2_1-302_2_*n* of the transmission channels CL[1]-CL[n], the voltage level transformers 304_1-304_*n*, the polarization digital-to-analog converters 306_1-306_*n* and the output module 308 comprising the operational amplifiers 308_1-308_*n* are similar to the operations of the source driver 30, and are not described hereinafter. In other words, the source driver 40 of the embodiment can utilize the decoder 400 to process the mapping operation of the display information DATA(A), DATA(B), . . . , DATA(X) and DATA(Y) and output the display information DATA(B), DATA(A), . . . , DATA(Y) and DATA(X) to the transmission channels CL[1]-CL[n], respectively, and utilize the output module 308 to process the odd-number switching operation, so as to output the plurality of voltage levels −V(A), V(B), −V(C), V(D), . . . , −V(X) and V(Y) corresponding to the transmission channels CL[1]-CL[n]. In brief, as shown in FIG. 4A, the source driver 40 receives the display information DATA (A), DATA(B), DATA(C), DATA(D), . . . , DATA(X) and DATA(Y) to correspondingly output the plurality of voltage levels −V(A), V(B), −V(C), V(D), . . . , −V(X) and V(Y) corresponding to the transmission channels CL[1]-CL[n].

Figure 5A:
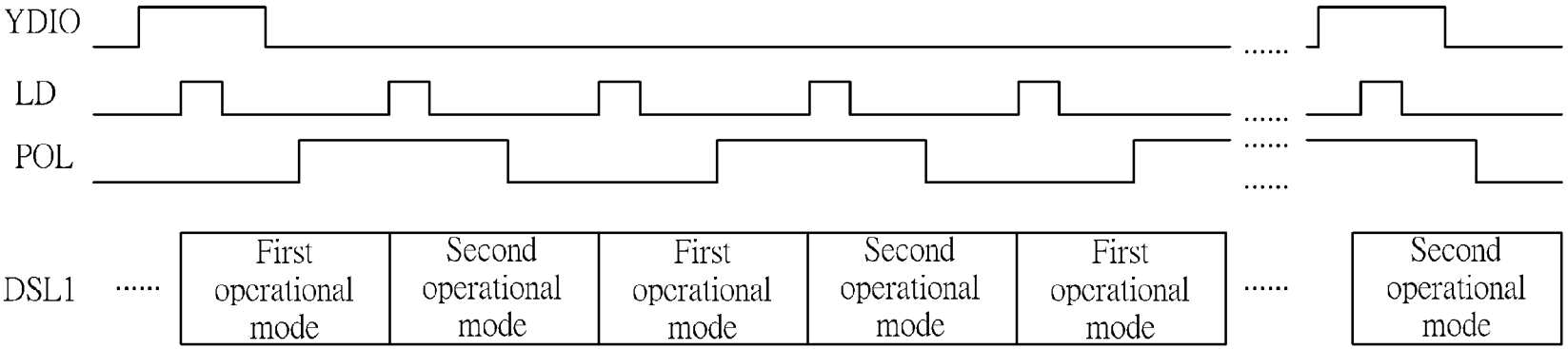
FIG. 5A illustrates a schematic diagram of operations of the decoder shown in FIG. 4B with a Dot Inversion Rule to map the display information according to an embodiment of the invention.
Figure 5B:
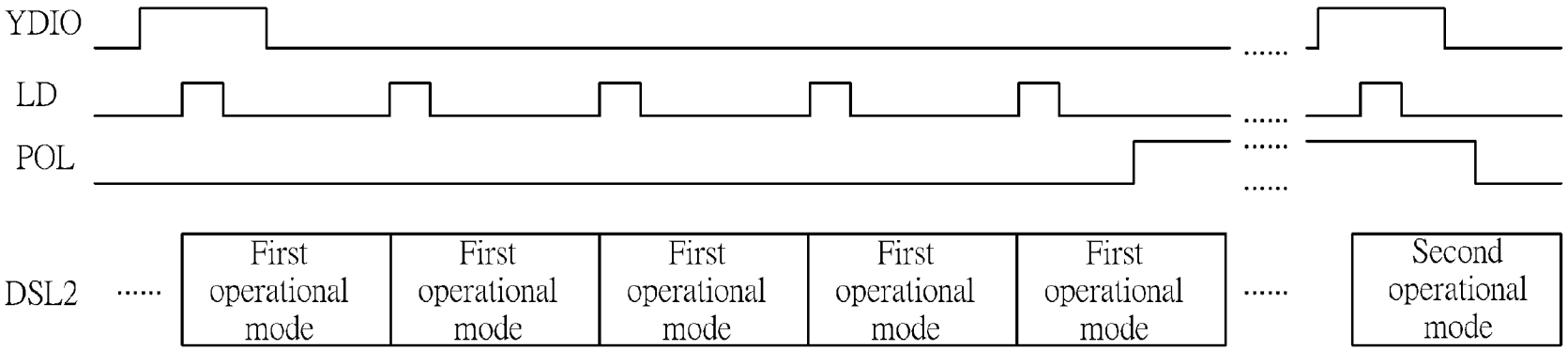
FIG. 5B illustrates a schematic diagram of operations of the decoder shown in FIG. 4B with a Column Inversion Rule to map the display information according to an embodiment of the invention.
Figure 5C:
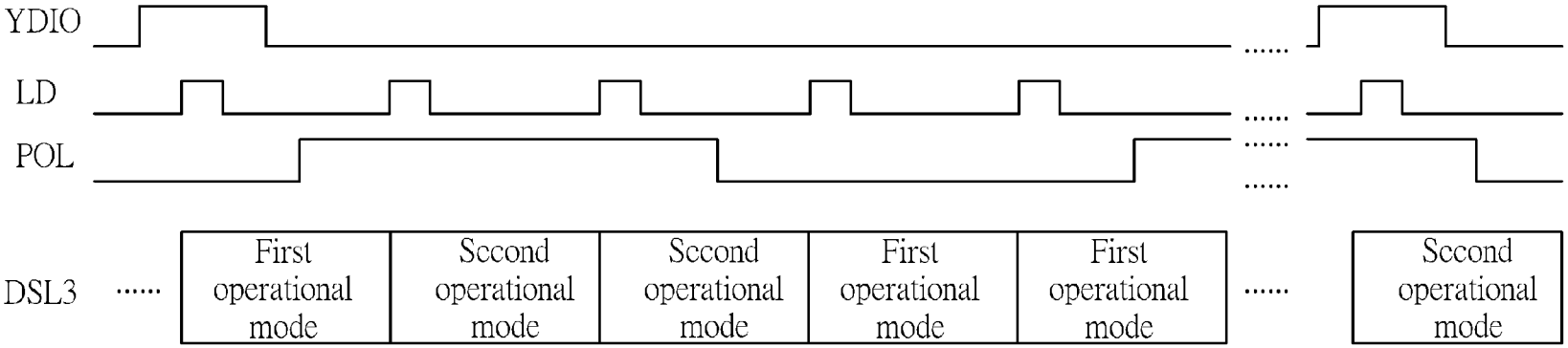
FIG. 5C illustrates a schematic diagram of operations of the decoder shown in FIG. 4B with a 1+2 Line Inversion Rule to map the display information according to an embodiment of the invention.

Refer to FIG. 5A, FIG. 5B and FIG. 5C, wherein FIG. 5A illustrates a schematic diagram of operations of the decoder 400 shown in FIG. 4B with a Dot Inversion Rule to map the display information according to an embodiment of the invention, FIG. 5B illustrates a schematic diagram of operations of the decoder 400 shown in FIG. 4B with a Column Inversion Rule to map the display information according to an embodiment of the invention, and FIG. 5C illustrates a schematic diagram of operations of the decoder 400 shown in FIG. 4B with a 1+2 Line Inversion Rule to map the display information according to an embodiment of the invention.

As shown in FIG. 5A, the decoder 400 receives the polarization control signal POL, the frame initiation signal YDIO and an information signal LD, and the information signal LD indicates that the display information of each line have been transmitted to the first register units 302_1_*x* of the register module 302_1. In detail, the decoder 400 determines of an initiation position of the display information corresponding to a first line in each frame in the display information (e.g. INDA_4) and determines a polarization pattern of the first line of the frame, according to one pulse signal of the frame initiation signal YDIO, and accordingly, determines an inversion rule for display information to be Dot Inversion Rule according to the polarization control signal POL, and further determines the polarization patterns of the following lines in the same frame, so as to adaptively switch the operational modes of the source driver 40. For example, as shown in FIG. 5A, a detection signal DSL1 is utilized to determine whether the first operational mode Phase I or the second operational mode Phase II is operated. Next, the decoder 400 also maps the plurality of display information corresponding to different transmission channels to the correct transmission channels. Since the inversion rule for display information is known according to the polarization control signal POL in a period of the previous frame, such that when another pulse signal of the frame initiation signal YDIO is generated, the decoder 400 processes the mapping/outputting operation with different polarization compared to the previous frame, and accordingly, the decoder 400 can continuously process such repeatable operations thereof.

Additionally, as shown in FIG. 5B, the decoder 400 can output the mapped display information via the Column Inversion Rule. In that, the decoder 400 receives one pulse signal of the frame initiation signal YDIO to determine an initiation position of the display information corresponding to a first line in each frame in the display information (e.g. INDA_4), and the decoder 400 determines a polarization pattern of the first line of the frame, determines an inversion rule for display information to be Column Inversion Rule according to the polarization control signal POL, and further determines the polarization patterns of the following lines in the same frame, so as to adaptively switch the operational modes of the source driver 40. For example, as shown in FIG. 5B, a detection signal DSL2 is utilized to determine whether the first operational mode Phase I or the second operational mode Phase II is operated. Next, the decoder 400 also maps the plurality of display information corresponding to different transmission channels to the correct transmission channels. Since the inversion rule for display information is known according to the polarization control signal POL in a period of the previous frame, such that when another pulse signal of the frame initiation signal YDIO is generated, the decoder 400 processes the mapping/outputting operation with different polarization compared to the previous frame, and accordingly, the decoder 400 can continuously process such repeatable operations thereof.

Furthermore, as shown in FIG. 5C, the decoder 400 can output the mapped display information via the 1+2 Line Inversion Rule. In that, the decoder 400 receives one pulse signal of the frame initiation signal YDIO to determine an initiation position of the display information corresponding to a first line in each frame in the display information (e.g. INDA_4), and the decoder 400 determines a polarization pattern of the first line of the frame, determines an inversion rule for display information to be 1+2 Line Inversion Rule according to the polarization control signal POL, and further determines the polarization patterns of the following lines in the same frame, so as to adaptively switch the operational modes of the source driver 40. For example, as shown in FIG. 5C, a detection signal DSL3 is utilized to determine whether the first operational mode Phase I or the second operational mode Phase II is operated. Next, the decoder 400 also maps the plurality of display information corresponding to different transmission channels to the correct transmission channels. Since the inversion rule for display information is known according to the polarization control signal POL in a period of the previous frame, such that when another pulse signal of the frame initiation signal YDIO is generated, the decoder 400 processes the mapping/outputting operation with different polarization compared to the previous frame, and accordingly, the decoder 400 can continuously process such repeatable operations thereof.

Figure 6:
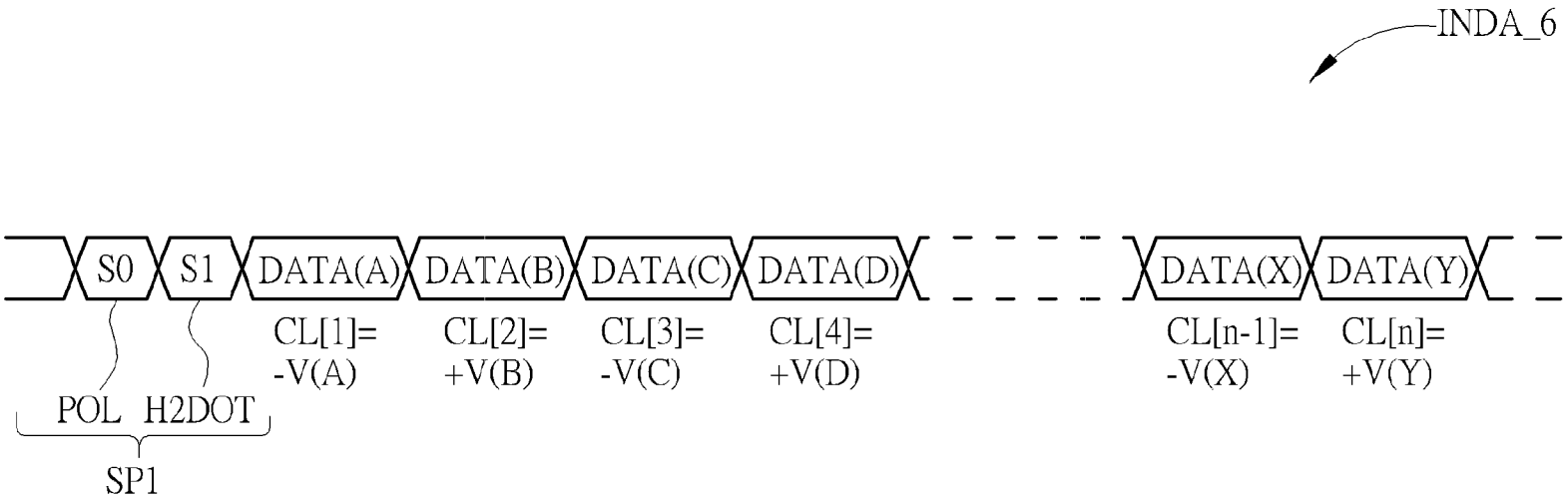
FIG. 6 illustrates a schematic diagram of a display information received by the decoder shown in FIG. 4B according to an embodiment of the invention.

Besides, the display information of the embodiment can be adaptively embedded with a setting packet to inform the decoder 400 of processing the mapping operation with different polarization. Please refer to FIG. 6, which illustrates a schematic diagram of a display information INDA_6 received by the decoder 400 shown in FIG. 4B according to an embodiment of the invention. As shown in FIG. 6, the display information INDA_6 not only comprises the display information DATA(A), DATA(B), . . . , DATA(X) and DATA (Y), but also comprises a setting packet SP1 being disposed at a position in front of a position of the display information DATA(A) and representing a polarization setting signal. The setting packet SP1 comprises two bits S0 and S1, and a coding pattern of the bit S1 is a H2DOT coding. For example, a normal coding is (−, +, −, +) and the H2DOT coding is the (−, +, +, −). Under such circumstances, the two bits S0 and S1 are utilized to instruct the decoder 400 to process a similar reversing polarization operation of the polarization control signal POL.

Figure 7:
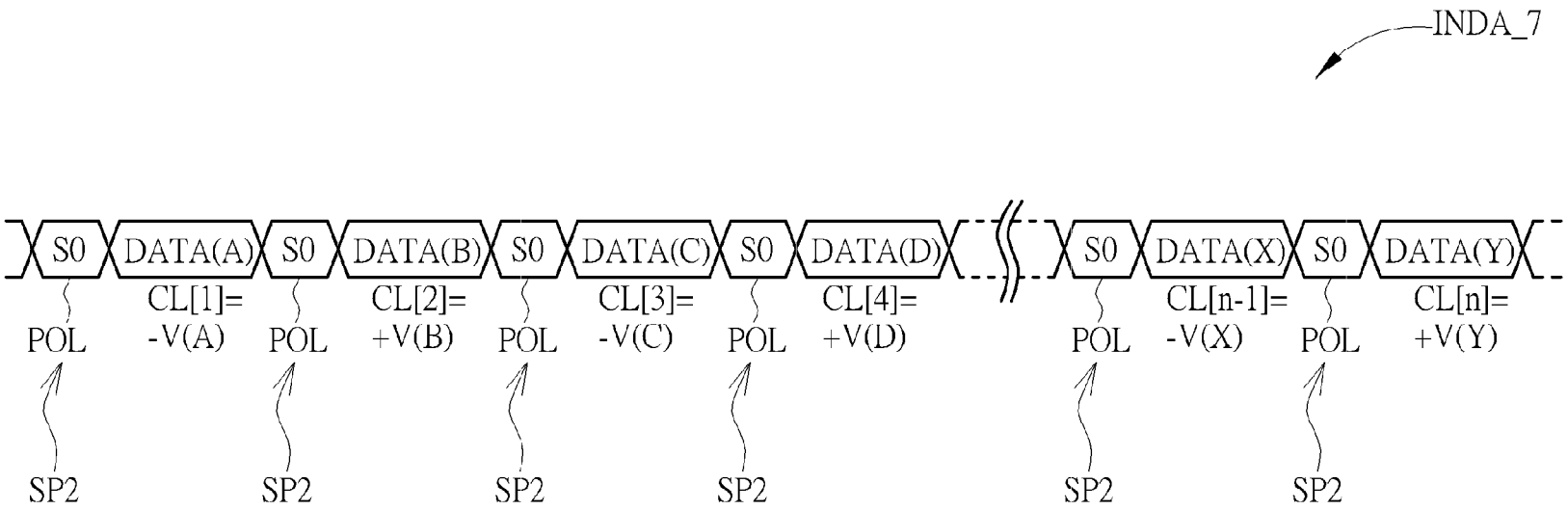
FIG. 7 illustrates a schematic diagram of another display information received by the decoder 400 shown in FIG. 4B according to an embodiment of the invention.

Moreover, please refer to FIG. 7, which illustrates a schematic diagram of another display information INDA_7 received by the decoder 400 shown in FIG. 4B according to an embodiment of the invention. As shown in FIG. 7, the display information INDA_7, in comparison with the display information INDA_6 shown in FIG. 6, comprises a setting packet SP2 comprising a bit S0, which is also the information indicating the reversing polarization operation of the polarization control signal POL. Accordingly, the display information INDA_7 has the setting packet SP2 be repeatedly embedded at a position between positions of every two display information, such that the display information INDA_7 has the position arrangement as DATA(A), SP2, SATA(B), SP2, . . . , DATA(Y). Certainly, those skilled in the art can adaptively modify/adjust the position arrangements of the display information INDA_6 and INDA_7 of the embodiments with other setting packets having different position arrangements, so as to simultaneously transmit the plurality of display information and the setting packet to the decoder 400, which is not limiting the scope of the invention.

Figure 8:
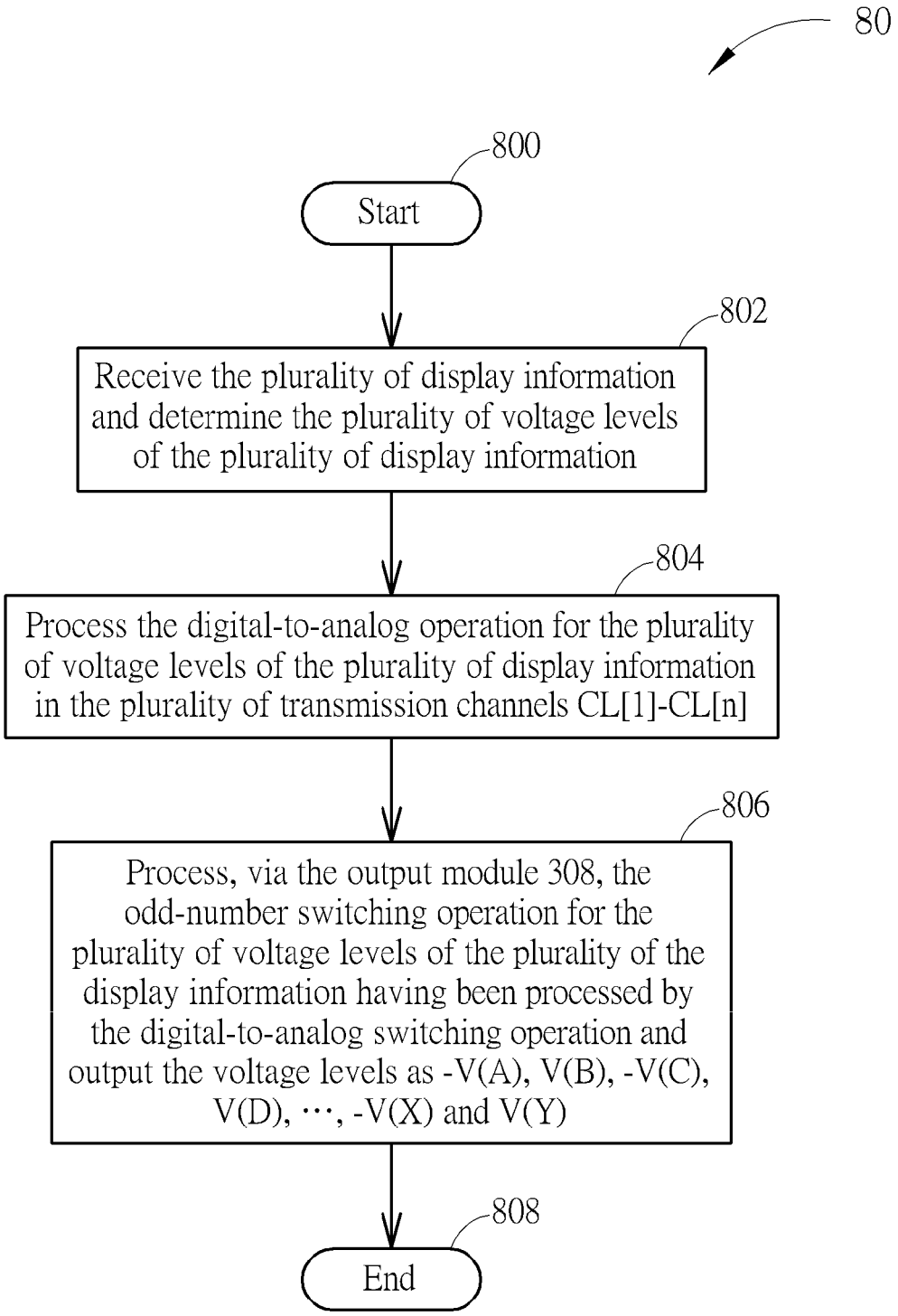
FIG. 8 illustrates a flow chart of a driving process according to an embodiment of the invention.

Further, a driving method for the source drivers 30 and 40 being operated in the second operational mode can be summarized as a driving process 80, as shown in FIG. 8, to be stored in a driving chip of the display device. The driving process 80 includes the following steps:

Step 800: Start.

Step 802: Receive the plurality of display information and determine the plurality of voltage levels of the plurality of display information.

Step 804: Process the digital-to-analog operation for the plurality of voltage levels of the plurality of display information in the plurality of transmission channels CL[1]-CL [n].

Step 806: Process, via the output module 308, the odd-number switching operation for the plurality of voltage levels of the plurality of the display information having been processed by the digital-to-analog switching operation and output the voltage levels as −V(A), V(B), −V(C), V(D), . . . , −V(X) and V(Y).

Step 808: End.

Detailed operations of each of the steps in the driving process 80 can be understood via the source drivers 30 and 40 and related paragraphs thereof, which is not repeated hereinafter for brevity. Preferably, if step 802 is utilized for the source driver 30, the plurality of display information is received by cooperating with the polarization control signal POL, the timing controller and the shift register 300; if step 802 is utilized for the source driver 40, the plurality of display information is received by cooperating with the polarization control signal POL and the decoder 400. Before processing step 802 of determining the plurality of voltage levels of the plurality of display information, the source drivers 30 and 40 adaptively map the plurality of display information to the corresponding transmission channels CL[1]-CL[n] in advance. Those skilled in the art can reference the display information INDA_6 and INDA_7 shown in FIG. 6 and FIG. 7 to modify operations of step 802 as directly embedding the setting packet indicating the reversing polarization information between the plurality of display information, or the Dot Inversion Rule, the Column Inversion Rule or the 1+2 Line Inversion Rule can also be interpreted to be other determining processes to cooperate with the operations of step 802, which is also in the scope of the invention.

In summary, embodiments of the invention provide the mapping operation and the odd-number switching operation for the source driver, such that the source driver can be switched between the two operational modes. Preferably, a decoder (or a timing controller and a shift register) utilizes a polarization control signal to control the mapping operation of the display information, and an output module processes the odd-number switching operation for the display information corresponding to the plurality of transmission channels, or other setting packets can also be embedded in the plurality of display information, such that the source driver of the invention can be operated in the two operational modes without the necessary of changing the connections of the hardware devices/units, and more flexible designs/application of the source driver is obtained, accordingly.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A source driver utilized for a display device comprising:

a decoder, for receiving a plurality of display information, a polarization control signal and a frame initiation signal, determining, an inversion rule for display information according to the polarization control signal, and mapping the plurality of display information to be a plurality of mapped display information according to the frame initiation signal and the polarization control signal;

a plurality of transmission channels, wherein each transmission channel of the plurality of transmission channels comprises:

a register module, coupled to the decoder, for receiving one of the plurality of mapped display information;

a voltage level transformer, coupled to the register module, for determining a voltage level of one of the plurality of mapped display information; and a polarization digital-to-analog converter, coupled the voltage level transformer, for processing a digital-to-analog operation for the voltage level of the one of the plurality of mapped display information; and an output module, coupled to a plurality of polarization digital-to-analog converters of the plurality of transmission channels, for outputting a plurality of voltage levels corresponding to the plurality of mapped display information having been processed by the digital-to-analog operation;

wherein the plurality of voltage levels corresponding to every two adjacent transmission channels comprise different polarization of voltage levels, and the output module further processes an odd-number switching operation before outputting the plurality of voltage levels.

2. The source driver of claim 1, wherein the output module further comprises a plurality of operational amplifiers to amplify the plurality of voltage levels of the plurality of mapped display information, and the odd-number switching operation switches the mapped display information outputted by every two adjacent transmission channels once or an odd number times.

3. The source driver of claim 1, wherein the inversion rule for display information is a Dot Inversion Rule, a Column Inversion Rule or a 1+2 Line Inversion Rule.

4. The source driver of claim 1, wherein the decoder is further configured for determining a polarization pattern of display information of a first line of a frame, and determining polarization patterns of subsequent lines in the frame according to the determined inversion rule.

5. A driving method for a source driver utilized for a display device, the driving method comprising:

receiving a plurality of display information, by a decoder of the source driver, a polarization control signal and a frame initiation signal;

determining an inversion rule for display information according to the polarization control signal;

mapping, by the decoder of the source driver, the plurality of display information to be a plurality of mapped display information sent to a plurality of transmission channels according to the frame initiation signal and the polarization control signal;

transforming a plurality of voltage levels of the plurality of mapped display information after the plurality of mapped display information are transmitted to the plurality of transmission channels;

processing a digital-to-analog operation for the plurality of voltage levels of the plurality of mapped display information in the plurality of transmission channels;

processing an odd-number switching operation for the plurality of voltage levels of the plurality of mapped display information having been processed by the digital-to-analog operation; and outputting the plurality of voltage levels corresponding to the plurality of mapped display information having been processed by the digital-to-analog operation, after the odd-number switching operation is performed;

wherein the plurality of voltage levels corresponding to every two adjacent transmission channels comprise different polarization of voltage levels.

6. The driving method of claim 5, further comprising utilizing a plurality of operational amplifiers to amplify the plurality of voltage levels of the plurality of mapped display information, and the odd-number switching operation switches the mapped display information outputted by every two adjacent transmission channels once or an odd number times.

7. The driving method of claim 5, wherein the inversion rule for display information is a Dot Inversion Rule, a Column Inversion Rule or a 1+2 Line Inversion Rule.

8. The driving method of claim 5, further comprising:

determining, by the decoder, a polarization pattern of display information of a first line of a frame, and determining polarization patterns of subsequent lines in the frame according to the determined inversion rule.

* * * * *